United States Patent [19]

Laszlo et al.

[11] 4,266,983

[45] May 12, 1981

[54] METHOD OF, AND MEANS FOR, REDUCING THE LIQUID CONTENT OF AIR-PERMEABLE MATERIAL IN TUBULAR FORM

[75] Inventors: Akos Laszlo, Nottingham; Horace B. Merriman, South Ascot, both of England

[73] Assignee: Courtaulds Limited, London, England

[21] Appl. No.: 19,629

[22] Filed: Mar. 12, 1979

[51] Int. Cl.[3] ..... B08B 5/04

[52] U.S. Cl. ..... 134/21; 15/302; 15/306 A; 15/307; 15/345; 26/81; 26/85; 34/23; 34/34

[58] Field of Search ..... 15/301, 302, 303, 306 R, 15/306 A, 307, 345; 134/21, 32; 34/22, 23, 34; 26/80, 81, 85

[56] References Cited

U.S. PATENT DOCUMENTS

| | | | |
|---|---|---|---|
| 1,236,359 | 8/1917 | Reynolds | 15/306 A X |
| 1,964,691 | 6/1934 | Shippling | 26/85 X |
| 2,597,801 | 5/1952 | Elliott | 15/306 A |
| 3,466,695 | 9/1969 | McCallister | 15/306 R |
| 3,653,425 | 4/1972 | Elliott et al. | 15/302 X |
| 3,654,659 | 4/1972 | Blumenthal | 15/306 A |

FOREIGN PATENT DOCUMENTS

| | | | |
|---|---|---|---|
| 588407 | 5/1947 | United Kingdom | 15/306 A |

*Primary Examiner*—Christopher K. Moore
*Attorney, Agent, or Firm*—Davis, Hoxie, Faithfull & Hapgood

[57] ABSTRACT

A method of reducing the liquid content of air-permeable material in tubular form, especially for reducing the moisture content of tubular fabric, involves moving the tube of material longitudinally through a device for applying suction to the outer surface of the tube, either in a single area which extends all round the tube or in a plurality of areas which together extend substantially all round the tube.

Means for carrying the method into effect may comprise one or more hollow members defining a frame to surround the tube of material from which liquid is to be removed. Each hollow member has apertures in its inwardly-facing wall, each of which apertures communicates with the hollow interior of its hollow member, and means is provided for creating a sub-atmospheric pressure in each hollow member. Preferably, the apertures are in the form of elongate slots having a length considerably greater than their width, and the axis of each slot is inclined at an angle of from 5 to 10 degrees to the direction of advance of the tubular fabric.

The liquid extraction means may be combined with hot air drying apparatus disposed downstream of the suction applying means and/or with squeeze rollers disposed upstream of the suction applying means.

13 Claims, 16 Drawing Figures

Figure 1:
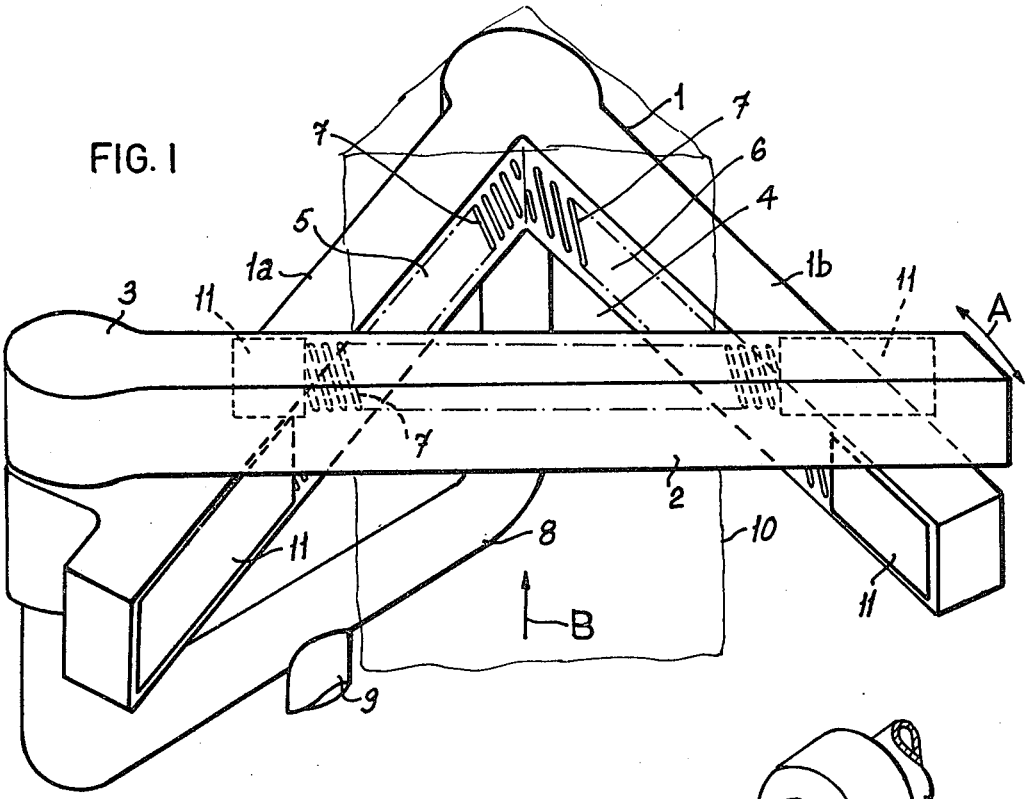

FIG.6
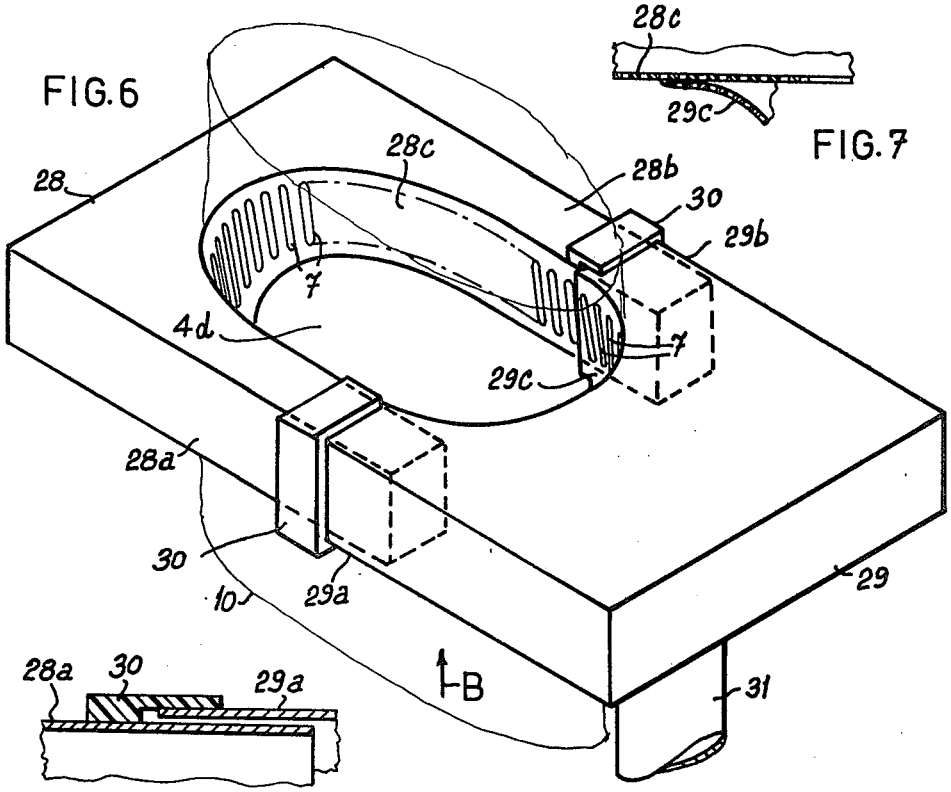
FIG.7
FIG.8
FIG.2
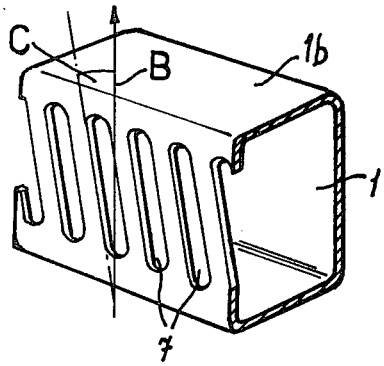

METHOD OF, AND MEANS FOR, REDUCING THE LIQUID CONTENT OF AIR-PERMEABLE MATERIAL IN TUBULAR FORM

This invention relates to a method of, and means for, reducing the liquid content of air-permeable material in tubular form. In particular, but not exclusively, it relates to a method of, and apparatus for, reducing the liquid content, and especially the moisture content, of tubular fabric.

It is frequently necessary in the textile industry to remove liquid from tubular fabric, for example fabric which has been treated in a dyebath or subjected to bleaching or finishing treatments in liquid baths.

It is known to remove liquid from tubular fabric by passing the fabric through an apparatus comprising squeeze rollers, for example a mangle, in order to express a considerable part of the liquid therefrom. However, after such a liquid removal process, the fabric may still contain liquid in an amount of up to 60 percent by weight of the dry weight of the fabric. In known liquid removal apparatus of this kind it is possible to pass the tubular fabric through the apparatus at speeds of up to 25 m/min.

Various methods are known for effecting a more complete drying of tubular fabric. One such method involves the use of hot air drying. The partially dried fabric, brought for instance from a mangle, is led over a stretcher for width regulation and then passes into a drying chamber where hot air is blown around and penetrates into the fabric. During the drying process, the tubular fabric fills with a mixture of hot air and vapour which flows in the direction opposite to that of the progession of the fabric, so that the fabric approaches the stretcher as a fully blown up tube. Practical operating speeds vary according to the type of fabric and other conditions, but under the most favourable conditions the speed of progression of the fabric through the drying chamber is not likely to exceed 15 m/min. If, therefore, such a drying chamber is employed to reduce still further the liquid content of tubular fabric which has been passed through squeeze rollers, the latter will not be used to their full capacity in a continuous process. Alternatively, the partially dried fabric coming from a number of squeeze rollers can be delivered to a greater number of drying chambers, but this means that the entire drying process becomes a batch process instead of a continuous process.

For reducing the liquid content of open widths of fabric, it is known to apply suction to a surface of the fabric. One known apparatus employing this principle comprises a suction tube having a diameter of for instance 100 mm which is connected to a source of vacuum and has a longitudinal slit of a width for instance of 3 mm. The fabric is guided partially around the suction tube, over the slit, with the tube disposed perpendicular to the direction of advance of the fabric. The time during which the fabric is exposed to the influence of suction is very short, and it is therefore necessary to employ a high degree of vacuum at the slit to achieve any worthwhile extraction of liquid, for example a vacuum of up to 500 mm of Hg. Such a high vacuum has the effect of partially drawing the fabric into the slit. This causes a considerable increase of the longitudinal tension in the fabric, causing a lengthwise stretching of the fabric and restricting the employement of the method to comparatively insensitive kinds of fabrics.

There is no industrially used process for the suction extraction of liquid from tubular fabric. It would not be impossible to suction extract liquid from flattened tubular fabric employing the longitudinally slit vacuum tube used with open width fabrics, but this would lead to the serious disadvantage of a difference in the extraction from the layer of the flattened fabric tube in direct contact with the suction slit and the other layer of the fabric tube which cannot be in direct contact with the suction slit.

The present invention aims to provide an improved method of, and improved means for, reducing the liquid content of air-permeable material in tubular form which do not have the disadvantages mentioned above.

According to one aspect of the invention, a method of reducing the liquid content of air-permeable material in tubular form comprises the step of moving the tube of material longitudinally through means for applying suction to the external surface of the tube in a single area which extends, or in a plurality of areas which together extend, substantially completely around the tube.

The suction applying means may be arranged to apply suction to the external surface of the tube of material in a single circumferential zone. Alternatively, the suction may be applied to a plurality of zones of the external surface of the tube, at least one of which zones is displaced from the other zone or zones in the direction of advance of the tube through the suction applying means.

According to a further aspect of the invention, a means for reducing the liquid content of air-permeable material in tubular form comprises one or more hollow members defining a frame to surround the tube of material, apertures in the inwardly-facing wall of the or each hollow member communicating with its hollow interior, means for creating a sub-atmospheric pressure within the or each hollow member and means for advancing the tube of material through the frame to move the external surface of the tube past the inwardly-facing, apertured wall of the or each hollow member.

The or each hollow member may consist of a tube, for example of rectangular cross-section, and the tube or tubes may be arranged to define a frame of circular, rectangular, triangular or other shape.

In a preferred embodiment of the means in accordance with the invention, each of the apertures in the or each hollow member is in the form of a substantially straight, elongate slot having a length considerably greater than its width and disposed in the inwardly-facing wall of the hollow member with its axis inclined slightly to the direction of advance of the tube of material through the frame. For example, each slot may have a width of from 3 to 4 mm and a length of up to 100 mm, and the slot axis may be inclined at an angle of from 5 to 10 degrees to the direction of advance of the tube through the frame. By providing the or each hollow member with a large number of such slots in close side-by-side relationship, the tube of material is subjected to suction extraction for a much longer time than in the case of suction extraction of open width fabrics, previously described, using a longitudinally slit suction tube. It is not, therefore, necessary to apply such a high degree of vacuum to the interior of the hollow member(s), a vacuum of from 100 to 150 mm of Hg being sufficient for most purposes. Consequently, the material being treated is not sucked into the slots to any great extent and the tube of material can be moved through the frame, without damage to the material, at a faster speed than in the case of suction extraction of open width fabrics using a longitudinally slit suction tube. In practice, the speed of advance of the tube of material through the frame can be as high as 25 m/min., which is the same speed as that at which the tube of material could be advanced through a pair of squeeze rollers for expressing liquid therefrom. Consequently, by employing this preferred embodiment of the means in accordance with the invention, it is possible to pass the tube of material directly from a pair of squeeze rollers to the suction extraction means in a continuously operated process. In a practical embodiment of such a process, it may be necessary to take steps to ensure that the flattened form of the tubular material as it leaves the squeeze rollers is converted to open tubular form before it enters the suction extraction means. Various ways in which this may be done will be described in detail hereinafter. Again, it may be necessary to ensure that there is a loop of slack material between the squeeze rollers and the suction extraction means, to allow for variations in speed of the tube of material as it passes through the two liquid removal stages.

In some cases it is desirable that the means in accordance with the invention should be adjustable so that it can be used to extract liquid from tubular material of different diameters. When said frame is constructed of a plurality of hollow members, these members may be movable relative to one another to vary the area of the window opening of the frame. When the frame consists of a single hollow member, or a plurality of hollow members fixed relative to one another, provision may be made for tilting the frame relative to the direction of advance of the tube of material through the frame, so that the area available to the tube of material can be varied.

The means in accordance with the invention may be combined with a hot air drying means for performing a final drying of the tubular material. This hot air drying means may comprise a pair of nip rollers for drawing the tubular material through the suction extraction means and then through a drying chamber of the hot air drying means. An embodiment of such a combined liquid extraction and drying means will be described hereinafter with reference to the drawings.

Although the invention has been described above in relation to the removal of liquid from tubular material, it will be appreciated that liquid may be removed very effectively from open width, air-permeable material using one of the aforesaid hollow members, provided with a plurality of elongate apertures in a wall thereof, in the interior of which a sub-atmospheric pressure is created. The invention therefore includes a method of removing liquid from open width, air-permeable material using such a hollow member.

Figure 9:
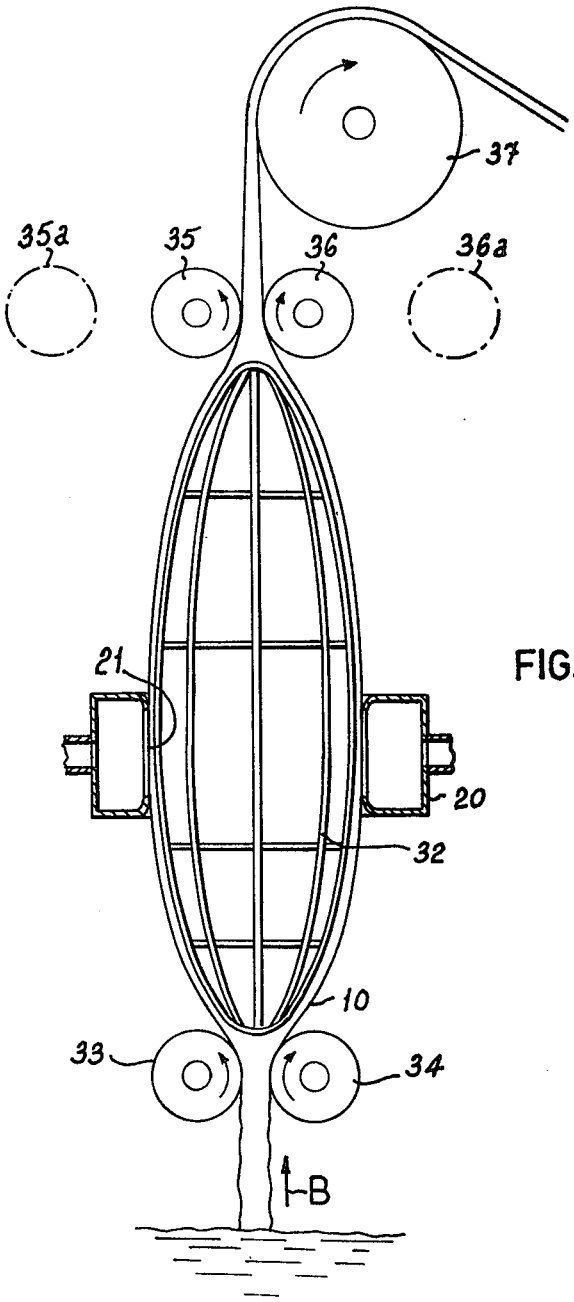
Figure 10:
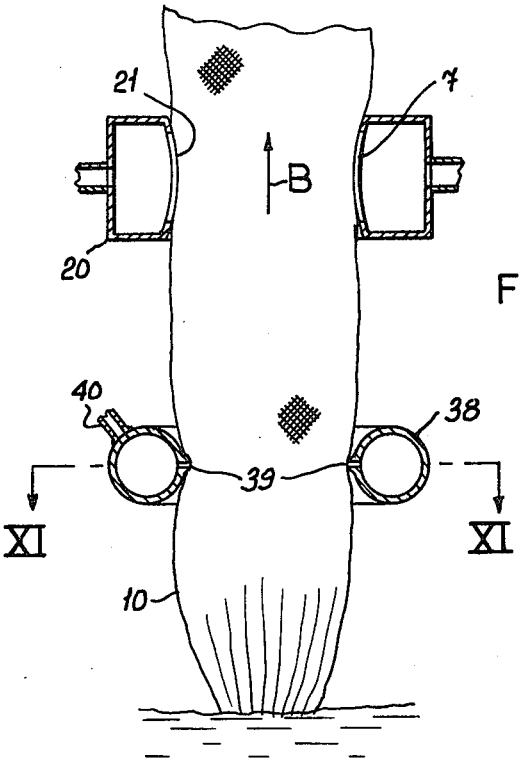
Figure 11:
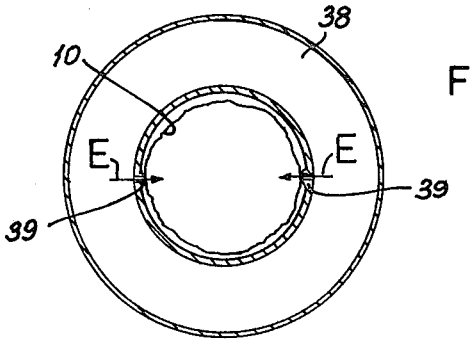
Figure 13:
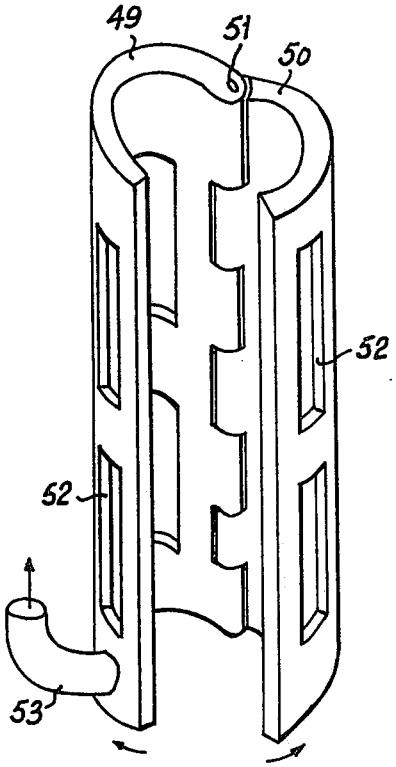
Figure 12:
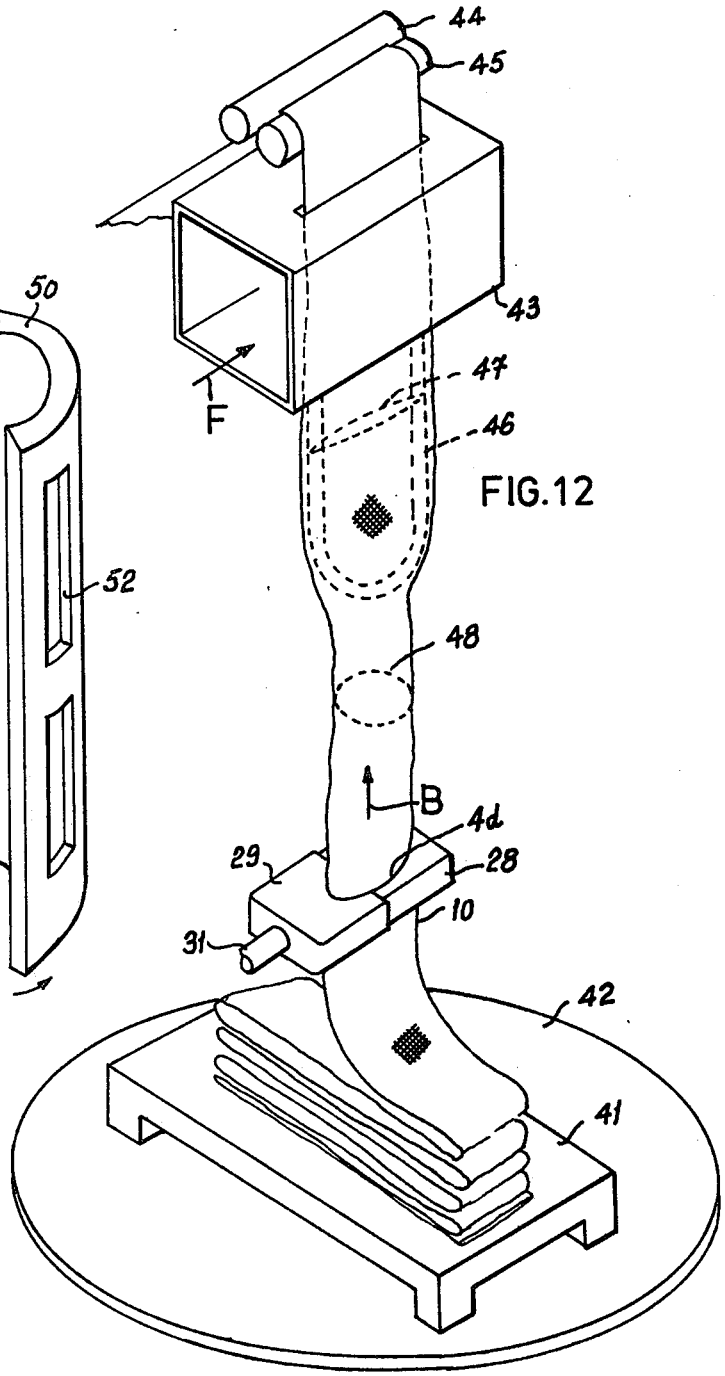

The invention will now be described, by way of example, with reference to the accompanying drawings, in which FIG. 1 is a schematic perspective view of a first embodiment of means in accordance with the invention, FIG. 2 is a perspective view, on an enlarged scale, of a portion of one of the hollow members of the means according to FIG. 1, FIGS. 3, 4, 5 and 6 are schematic perspective views of second, third, fourth and fifth embodiments of means in accordance with the invention, FIGS. 7 and 8 are sectional views of details of the means according to FIG. 6, FIGS. 9 and 10 are schematic sectional views of means in accordance with the invention illustrating two different ways of ensuring that the material being treated is presented to the suction extraction means in open tubular form, FIG. 11 is a sectional view taken on the line XI—XI of FIG. 10, FIG. 12 is a perspective view of means in accordance with the invention in combination with a hot air drying means, FIG. 13 is a schematic perspective view of a jacket for use with the apparatus shown in FIG. 12, and FIGS. 14 to 16 are schematic sectional views of means in accordance with the invention in combination with squeeze roller devices.

The means shown in FIG. 1 comprises two tubular members 1, 2 of rectangular cross-section. The member 1 is of V-shape, whereas the member 2 is straight. At its end 3 the member 2 is pivoted to the limb 1*a* of the member 1, and the member 2 can be swung in the directions indicated by the arrows A over the V-shaped member 1 with its lower surface resting on the upper surfaces of the limbs 1*a* and 1*b* of member 1. The two hollow members 1 and 2 define a frame with a triangular window opening 4, the area of which can be adjusted by adjustment of the position of the member 2 relative to the member 1. Any suitable means (not shown) is provided for clamping the member 2 in a desired position relative to the member 1.

The walls 5, 6 of the member 1 which face the window opening 4, and the wall of the member 2 which faces the window opening 4, are all provided with a plurality of elongate, through-slots 7 disposed in parallel, closely spaced-apart relationship. FIG. 2 shows a portion of the limb 1*b* of the member 1. In this Figure, the arrow B indicates the direction of advance of the tubular material to be dried when it is advanced past the limb 1*b* during use of the means. It will be seen that the slots 7 are inclined to the arrow B by an angle C, which is suitably from 5 to 10 degrees. The slots 7 in the inwardly-facing walls of the limb 1*a* and the member 2 are similarly inclined to the direction of advance of the tubular material through the window opening 4.

A tube 8 is connected to the hollow interiors of the members 1 and 2, one end of this tube serving as a pivot pin for the end 3 of the member 2. The tube 8 is connectible by means of a further tube 9 to a source of vacuum (not shown).

In use of the apparatus shown in FIG. 1, the tubular material 10 from which liquid is to be removed is advanced upwardly through the window opening 4, as indicated by the arrow B, and a sub-atmospheric pressure is created in the hollow interiors of the members 1 and 2 by connecting the tube 9 to the vacuum source. Prior to the liquid removal operation, the member 2 is adjusted relative to the member 1 to provide a window opening 4 having a area substantially equal to the cross-sectional area of the tubular material 10 and any of the slots 7 which lie outside the limits of the window opening 4 are masked with plates 11.

Figure 3:
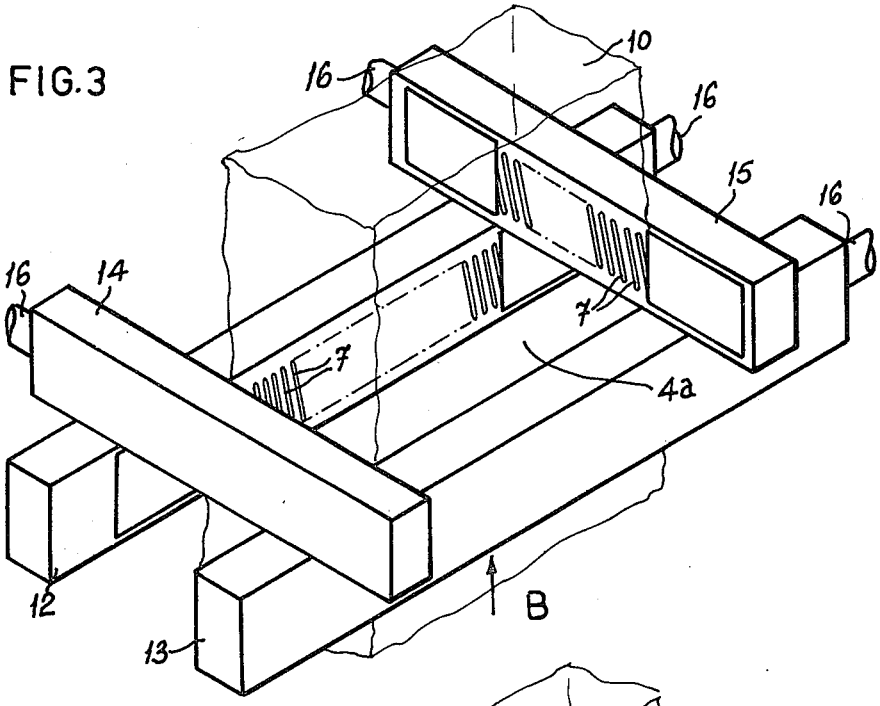

In the means shown in FIG. 3, the frame defining the rectangular window opening 4*a* through which the tubular material 10 advances in the direction of the arrow B, is formed by four straight, hollow members 12, 13, 14 and 15. Each of these hollow members has elongate slots 7 formed in its inwardly-facing wall, and the four members may have the same construction as the limb 1*b* shown in FIG. 2. The hollow interior of each of the members 12–15 is connected to a respective tube 16, these tubes being connectible to a source of vacuum (not shown). The members 14, 15 are supported on the upper surfaces of the members 12, 13 and they can be moved relative to the members 12, 13 to adjust the area of the window opening 4*a* to suit the area of the tubular material 10 passing therethrough. The members 14, 15 would be clamped to the members 12, 13 in any suitable way (not shown) after adjustment of the area of the window opening 4*a*. As in the case of the means described with reference to FIG. 1, any of the slots 7 lying outside the limits of the window opening 4*a* are masked with plates 11.

Figure 4:
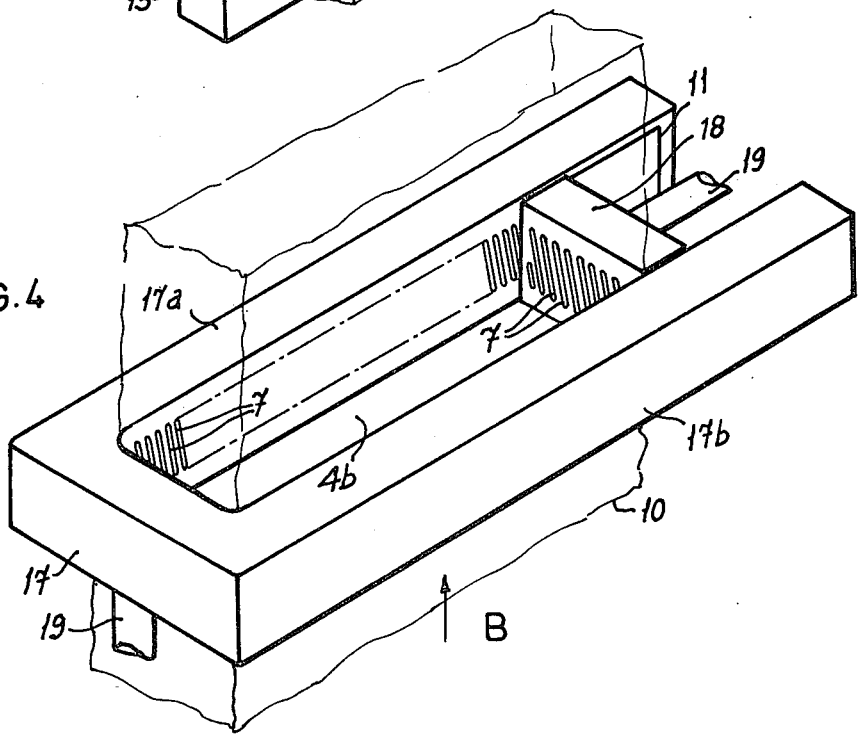

In the means shown in FIG. 4, the frame defining the rectangular window opening 4*b*, through which the tubular material 10 advances in the direction indicated by the arrow B, is formed by a U-shaped hollow member 17 and a short straight hollow member 18 disposed between the limbs 17*a* and 17*b* of the member 17. Each of the hollow members 17, 18 has elongate slots 7 formed in each of its inwardly-facing walls, and both members may be of the same construction as the limb 1*b* shown in FIG. 2. The hollow interior of each of the members 17, 18 is connected to a respective tube 19, these tubes being connectible to a source of vacuum (not shown). The member 18 can have its position adjusted between the limbs 17*a*, 17*b* in order to adjust the area of the window opening 4*b* to suit the cross-sectional area of the tubular material 10 passing therethrough. The member 18 would be clamped to the member 17 in any suitable way (not shown) after adjustment of the area of the window opening 4*b*. As in the case of the previously described embodiments, any of the slots 7 in the member 17 lying outside the limits of the window opening 4*b* are masked with plates 11.

Figure 5:
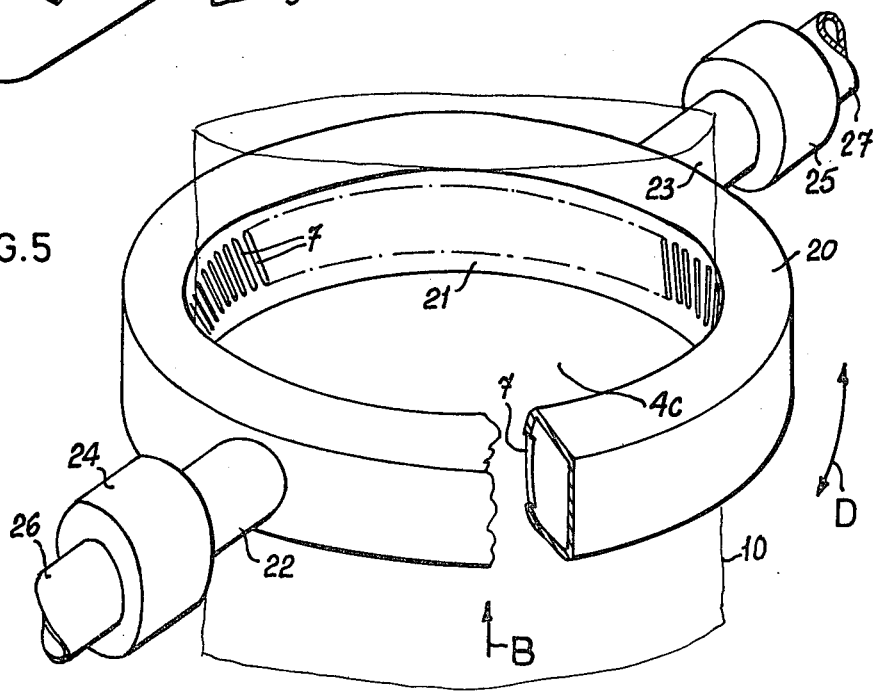

In the means shown in FIG. 5, the frame defining the circular window opening 4*c* through which the tubular material 10 advances in the direction of the arrow B, is formed by a single ring-shaped hollow member 20. This hollow member has elongate slots 7 formed all around its inwardly-facing wall 21, and again this hollow member can be constructed in the same way as the limb 1*b* shown in FIG. 2. The hollow member 20 is supported by diametrically opposed hollow spindles 22, 23 so that it can turn about a horizontal axis in the directions indicated by the arrows D. The spindles 22, 23 are supported in bearings 24, 25, respectively. The hollow interior of the member 20 is connected to the hollow spindles 22, 23 and the latter are connectible via tubes 26, 27, respectively, to a source of vacuum (not shown), the tubes 26, 27 being led into the bearings 24, 25, respectively. In use of the means shown in FIG. 5, the member 20 is tilted at such an angle to the horizontal that the apparent area of the window opening 4*c*, viewed from directly above, is substantially equal to the cross-sectional area of the tubular material 10 when in opened up form.

In the means shown in FIG. 6, the frame defining the oval window opening 4*d* through which the tubular material 10 advances in the direction indicated by the arrow B, is formed by two U-shaped hollow members 28, 29. The limbs 28*a*, 28*b* of the member 28 are slidable in the limbs 29*a*, 29*b*, respectively, of the member 29 for the purpose of adjusting the cross-sectional area of the window opening 4*d* to suit the cross-sectional area of the tubular material 10. A rubber seal 30 is provided to seal the gap between each of the limbs of the member 28 where they enter the limbs of the member 29, these seals extending along the upper, lower and outwardly facing surfaces only of the members 28 and 29. FIG. 8 shows the shape of the seals 30, this Figure being a sectional view through the seal between the upper surfaces of the limbs 28*a* and 29*a*. The inwardly-facing walls 28*c* and 29*c* of the hollow members 28 and 29, respectively, are each provided with elongate slots 7 throughout their length, these slots again being inclined to the direction of the arrow B as shown in FIG. 2. As shown in FIG. 7, which is a sectional plan of the walls 28*c* and 29*c* where the limb 28*b* enters the limb 29*b*, there is a close sliding fit between the walls 28*c* and 29*c* and the nose end of the wall 29*c* is curved to avoid a step-like transition so that the tubular material 10 will make continuous contact with the slotted walls 28*c* and 29*c*. The hollow interiors of the two members 28, 29 are connectible to a source of vacuum (not shown) by a tube 31 connected to the member 29.

FIG. 9 illustrates a provision for preventing the arrival of the tubular material 10 inside the slotted hollow member 20 of FIG. 5 in a partially collapsed state by the use of a cage 32 inserted into tubular material 10. The tubular material 10 in rope-like form proceeds in the direction of the arrow B between rolls 33, 34, through the hollow member 20 and finally through rolls 35 and 36. The rolls 33 and 34 prevent the cage 32 from dropping below them, thus locating the cage where it can guide the tubular material 10 in close proximity to the inwardly-facing slotted wall 21 of the hollow member 20. In order that the cage 32 can be inserted into the tubular material 10, the rolls 35 and 36 can be moved to the positions 35*a* and 36*a*, shown in chain lines, and then be returned to the positions shown in full lines. The rolls 35, 36 prevent the cage 32 from rising above its correct operating position. After leaving the rolls 35, 36, the tubular material 10 is led away over a roller 37. The cage 32 may be made from light wire material.

Cages similar to the cage 32 may be employed with the suction extraction means shown in FIGS. 1, 3, 4 and 6, the cage being given a cross-sectional shape to suit the window opening of the suction extraction means.

FIGS. 10 and 11 show a different arrangement for ensuring that the tubular material 10 arrives in open tubular form at the hollow member 20 of the suction extraction means of FIG. 5, in order to ensure contact with all the slots 7 in the inwardly-facing wall 21 of the member 20. For this purpose, the tubular material 10, in semicollapsed or rope form, moving upwardly in the direction of the arrow B, passes through a ring-shaped, tubular member 38 before reaching the hollow member 20. The tubular member 38 has one or more inwardly-facing nozzles 39 communicating with its hollow interior. Air under pressure is supplied to the tubular member 38 via a pipe 40, and this air issues as jets from the nozzles 39 as indicated by the arrows E in FIG. 11. These air jets penetrate the tubular material 10 and inflate it to open tubular form as it moves through the tubular member 38 towards the hollow member 20. The same arrangement may be employed with the suction extraction means illustrated in FIGS. 1, 3, 4 and 6.

FIG. 12 shows one example of the suction extraction means of FIG. 6 combined with a hot air dryer, for drying tubular fabric 10. The tubular fabric is drawn upwardly from a table 41 through the window opening 4*d* of the suction extraction means, and then through a drying chamber 43, by means of driven nip rollers 44, 45. The arrow B shows the direction of advance of the tubular fabric 10 in its passage between the suction extraction means and the drying chamber 43.

Pre-heated air under pressure is supplied to the drying chamber 43, as indicated by the arrow F, and the hot air penetrates the fabric 10 in the drying chamber and then flows downwardly in the tubular fabric, since its escape upwardly is hindered by the nip rollers 44, 45. Immediately below the drying chamber 43 the tubular fabric 10 passes over a stretcher 46 giving the fabric a more or less elliptical cross-section, indicated by the dotted line 47, as it enters the drying chamber. Below the stretcher 46, the fabric has a more circular cross-section, indicated by the dotted line 48.

In operation of the apparatus shown in FIG. 12, the flow of hot air inside the tubular fabric 10, in the direction opposite to that in which the fabric advances, results in enhanced utilisation of the hot air, so increasing the capacity of the hot air dryer. The hot air, mixed with vaporised liquid from the fabric, is suction extracted by the hollow members 28, 29 connected to a vacuum source (not shown) by the tube 31. Liquid carried up to the suction extraction means by the fabric 10 is also extracted by the hollow members 28, 29. During use of the apparatus, the table 41 can be rotated by means of a turn-table 42, either by hand or by automatic means (not shown), to take out any twist which may occur in the tubular fabric 10.

In its passage from the suction extraction means to the drying chamber 43, the tubular fabric 10 may be surrounded by a heat-insulating enclosure. Such an enclosure is shown in FIG. 13 and consists of two semi-cylindrical shells 49, 50 made of heat-insulating material and hinged together by a hinge pin 51. The shells 49, 50 are provided with observation windows 52 and one of the shells may be provided with an extraction duct 53 to encourage the flow of hot air downwardly in the fabric tube 10 and through the fabric.

Of course, a hot air dryer may be combined with any of the suction extraction means shown in FIGS. 1, 3, 4 and 5 instead of the suction extraction means 28, 29 shown in FIG. 12.

Figure 14:
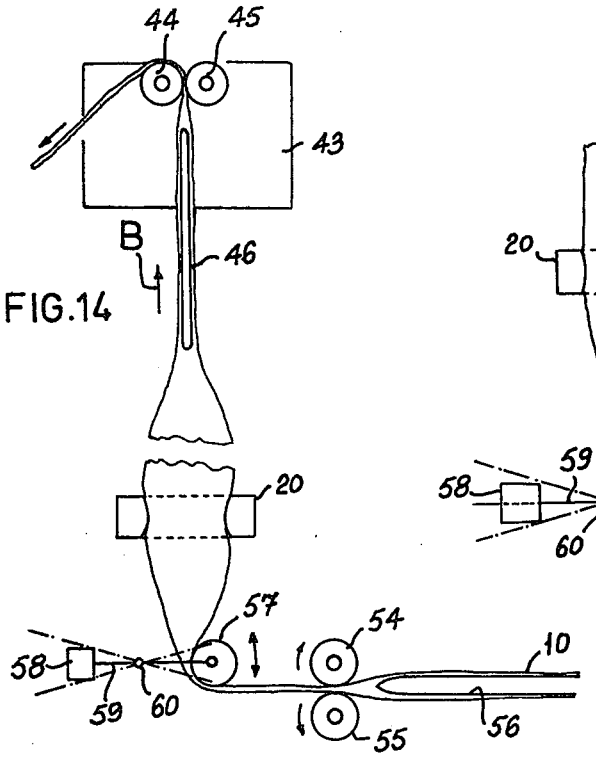

FIG. 14 illustrates apparatus for drying tubular material which comprises the combination of a mangle, a suction extraction means of the kind shown in FIG. 5 and a hot air dryer of the kind shown in FIG. 12. Referring to FIG. 14, the tubular fabric 10 from which liquid is to be removed enters a mangle comprising rollers 54, 55 over a stretcher 56 which ensures that the material enters the mangle in open tubular width and in basically crease-free condition. The tubular material 10 passes through the rollers 54, 55 in a horizontal direction and the rollers are urged together by weight or suitable hydraulic or pneumatic actuating means (not shown). The covering surface of one or both rollers may be made either from traditional rubber-type material or from one of the more recently introduced composition materials. The surface of one of the rollers may be metallic.

From the rollers 54, 55, the tubular material passes around a counter-balanced roller 57, the counter-balancing being provided by a counterweight 58 slidably adjustable on a lever arm 59. The position of the counterweight 58 in relation to the fulcrum 60 of the lever arm 59 is chosen so that the roller 57 has a tendency to move downwards if the mangle supplies more tubular fabric than is taken up by the nip rollers 44, 45 in the drying chamber 43. The movement of the roller 57 is transmitted electrically or mechanically (by means not shown) to a speed regulating device for the mangle, causing the latter to slow down when the roller 57 descends. In the opposite case, when the speed at which the nip rollers 44, 45 take up the tubular material 10 is faster than the speed at which the material is delivered from the mangle, the roller 57 will rise and this has the effect of increasing the speed of the mangle.

From the roller 57 the tubular material 10 passes upwardly, in the direction of the arrow B, through the hollow member 20 of the suction extraction means and then over a stretcher 46 into the drying chamber 43. The drying chamber functions in the same way as the drying chamber 43 of the apparatus shown in FIG. 12.

Figure 15:
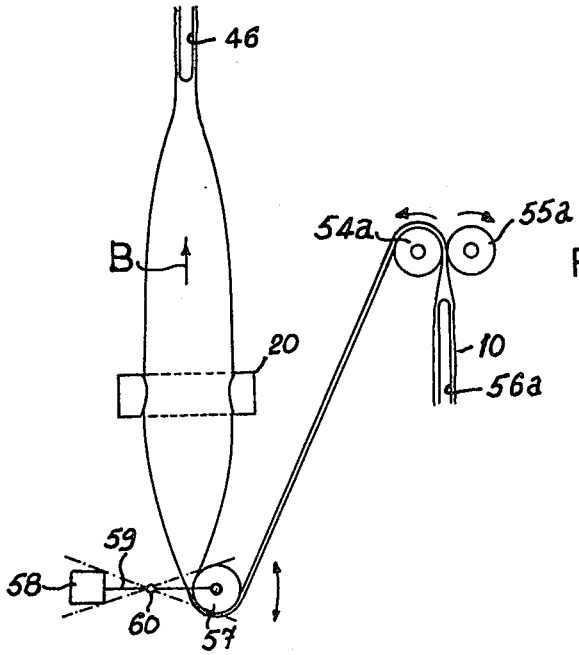

FIG. 15 illustrates a modified part of the apparatus of FIG. 14 in which the tubular material 10 enters the mangle rollers 54*a*, 55*a* in the vertically upward direction over a stretcher 56*a*. From the mangle rollers the tubular material travels along a downwardly inclined path to the counterbalanced roller 57. In all other respects the apparatus of FIG. 15 is the same as that of FIG. 14, and like parts have been designated with the same reference numerals in both Figures.

Figure 16:
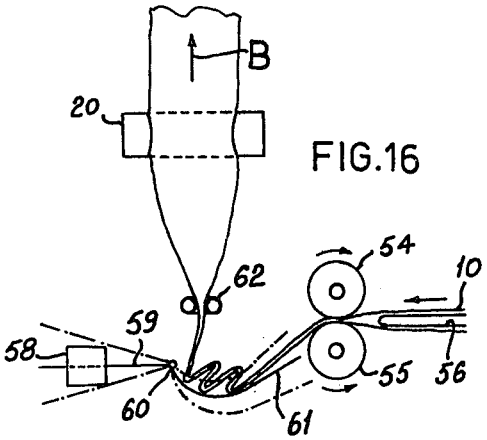

FIG. 16 illustrates another way of leading the tubular material 10 from the mangle rollers 54, 55 of the apparatus of FIG. 14 to the suction extraction member 20. From the rollers 54, 55 the tubular material 10 is deposited on a counterbalanced scray 61, the counterbalancing of which is provided by a weight 58 slidably adjustable on a lever 59 mounted on a fulcrum 60. If a few folds of the tubular material accumulate in the scray 61, the latter falls into its lower position causing the slowing down or temporary stopping of the mangle rollers 54, 55. If, on the other hand, the length of tubular material 10 in the scray decreases to a permitted minimum, then the scray pivots about the fulcrum 60 to its higher position resulting in speeding up or re-starting of the mangle.

From the scray 61 the tubular material 10 passes through a guide ring 62 to the suction extraction member 20. In all other respects the apparatus of FIG. 16 is the same as that of FIG. 14.

Of course, in each of the apparatus of FIGS. 14–16, the suction extraction means of any of FIGS. 1, 3, 4 and 6 may be used instead of that of FIG. 5.

What is claimed is:

1. A method of reducing the liquid content of air-permeable material in tubular form, said method comprising the steps of:

(a) moving the tube of material longitudinally through structure defining a surface surrounding the tube, and formed with elongated apertures inclined at a slight angle to the direction of the longitudinal axis of the tube, (b) applying forces to said tube to maintain it in open form and applied closely to said apertured surface, (c) applying suction to said apertures of create a gas current from within said tube out through said apertures.

2. A method according to claim 1 wherein said elongated apertures are inclined at an angle of no more than 10° to the direction of the longitudinal axis of the tube of material.

3. Apparatus for reducing the liquid content of air-permeable material in tubular form, said apparatus comprising:

(a) at least one hollow member defining a frame to surround the tube of material and presenting an inwardly-facing surface thereto, (b) said surface being formed with elongated apertures inclined at a slight angle to the longitudinal direction of a tube of material passing through said frame, (c) said apertures communicating with the interior of said at least one hollow member, (d) means for creating a sub-atmospheric pressure within said at least one hollow member, (e) means for advancing the tube of material through the frame to move the external surface of the tube past said inwardly-facing, apertured surface, (f) means for maintaining said tube in open form and applied closely to said surface, (g) whereby said suction will create a gas current from within and substantially only from within said tube into said at least one hollow member.

4. Apparatus according to claim 3, comprising means for adjusting the cross-sectional area of the window opening of the frame to suit tubular material of different sizes.

5. Apparatus according to claim 3, wherein each of the apertures in said apertured surface is in the form of a substantially straight, elongated slot having a length considerably greater than its width and disposed in the inwardly-facing wall of the hollow member with its axis inclined slightly to the direction of advance of the tubular material through the frame.

6. Apparatus according to claim 5, wherein the axis of each of said slots is inclined at an angle of no more than 10 degrees to the direction of advance of the tube of material through the frame.

7. Apparatus according to claim 3 comprising means for mounting said frame for pivotal movement about an axis substantially at right angles to the direction of advance of the tube of material through the frame, whereby the projected area for passage of the tube of material through the frame, on a plane disposed at right angles to the direction of advance of the tube of material, can be varied.

8. Apparatus according to claim 3 in combination with apparatus for blowing hot air into the tube of material downstream of said suction applying means, and means for inducing the hot air blown into the tube of material to flow along the latter in the direction opposite to the direction of advance of the tube of material through said frame.

9. Apparatus according to claim 8, wherein the means for inducing said flow of hot air in the tube of material comprises a pair of driven nip rollers downstream of the region where the hot air is blown into the tube of material, said nip rollers serving to advance the tube of material both through said frame and through the apparatus for blowing hot air into the tube of material.

10. Apparatus according to claim 8, wherein the tube of material is arranged to pass over stretching means located between said frame and the apparatus for blowing hot air into the tube of material.

11. Apparatus according to claim 8, comprising a heat insulating jacket located between said frame and the apparatus for blowing hot air into the tube of material, through which the tube of material advances in its passage from said frame to the apparatus for blowing hot air into the tube.

12. Apparatus according to claim 11, wherein said jacket is provided with means for exhausting hot air and vapour from a zone of the jacket disposed at or adjacent the end of the jacket lying nearer to said frame.

13. Apparatus according to claim 3 in combination with means disposed upstream of said frame for squeezing out part of the liquid content of the tube of material by passing the tube through driven nip rollers, and means for synchronising the speed of rotation of the nip rollers with the speed of advance of the tube of material through said frame.

* * * * *